US007420329B2

(12) United States Patent
Kang

(10) Patent No.: US 7,420,329 B2
(45) Date of Patent: Sep. 2, 2008

(54) PLASMA DISPLAY PANEL (PDP)

(75) Inventor: Kyoung-Doo Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 481 days.

(21) Appl. No.: 11/267,343

(22) Filed: Nov. 7, 2005

(65) Prior Publication Data

US 2006/0119266 A1 Jun. 8, 2006

(30) Foreign Application Priority Data

Dec. 4, 2004 (KR) ..... 10-2004-0101525

(51) Int. Cl.
*H01J 17/49* (2006.01)

(52) U.S. Cl. ..... 313/583; 313/582; 313/584; 313/585

(58) Field of Classification Search ..... 313/582–587; 315/169.1, 169.4; 345/37, 41, 60, 71
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |

(Continued)

FOREIGN PATENT DOCUMENTS

| | | |
|---|---|---|
| JP | 2845183 | 10/1998 |

(Continued)

OTHER PUBLICATIONS

"*Final Draft International Standard*", Project No. 47C/61988-1/Ed. 1; Plasma Display Panels—Part 1: Terminology and letter symbols, published by International Electrical Commission, IEC. in 2003, and Appendix A—Description of Technology, Annex B—Relationship Between Voltage Terms and Discharge Characteristics; Annex C—Gaps and Annex D—Manufacturing.

*Primary Examiner*—Nimeshkumar Patel
*Assistant Examiner*—Donald L Raleigh
(74) *Attorney, Agent, or Firm*—Robert E. Bushnell, Esq.

(57) ABSTRACT

A Plasma Display Panel (PDP) includes: an upper substrate; a lower substrate facing the upper substrate; and a plurality of blocks. Each block includes: a barrier rib of a dielectric material adapted to define discharge cells; upper discharge electrodes including upper discharge portions arranged in the barrier rib and upper connection portions connected to the upper discharge portions and protruding out of the barrier rib; and lower discharge electrodes including lower discharge portions arranged in the barrier rib and separated from the upper discharge portions and lower connection portions connected to the lower discharge portions and protruding out of the barrier rib. Phosphor layers arranged in the discharge cells. The plurality of blocks are connected to each other by connecting the upper connection portions and the lower connection portions thereof.

18 Claims, 7 Drawing Sheets

U.S. PATENT DOCUMENTS 6,707,436 B2 3/2004 Setoguchi et al.
7,245,077 B2 * 7/2007 Amano ..... 313/582

FOREIGN PATENT DOCUMENTS

JP 2917279 4/1999
JP 2001-043804 2/2001
JP 2001-325888 11/2001

* cited by examiner

PLASMA DISPLAY PANEL (PDP)

CLAIM OF PRIORITY

This application makes reference to, incorporates the same herein, and claims all benefits accruing under 35 U.S.C. §119 from an application entitled PLASMA DISPLAY PANEL, earlier filed in the Korean Intellectual Property Office on Dec. 4, 2004 and there duly assigned Serial No. 10-2004-0101525.

BACKGROUND OF THE INVENTION

1. Field of the Invention

The present invention relates to a Plasma Display Panel (PDP). More particularly, the present invention relates to a PDP which displays images using a gas discharge phenomenon.

2. Description of the Related Art

A display apparatus using a PDP has large screen and a high image quality. It is ultra-thin, light weight, and has a wide viewing angle. In addition, the display apparatus is easily manufactured and a very large display apparatus is possible.

PDPs can be classified into Direct Current (DC) PDPs, Alternating Current (AC) PDPs, and hybrid PDPs according to their driving method. In addition, the PDPs can be classified into opposing discharge display panels and surface discharge display panels according to their discharge structure. AC PDPs having a three-electrode surface discharge structure are now generally used.

An AC PDP having a three-electrode surface discharge structure includes an upper substrate and a lower substrate. Common electrodes and scan electrodes forming discharge gaps with the common electrodes are formed on a lower surface of the upper substrate, and the common and scan electrodes are embedded in an upper dielectric layer. A protective layer is formed on a lower surface of the upper dielectric layer.

In addition, address electrodes are formed on an upper surface of the lower substrate to cross the common and scan electrodes, and the address electrodes are embedded in a lower dielectric layer. Barrier ribs are formed on an upper surface of the lower dielectric layer and are separated from each other to define discharge spaces. A phosphor layer is formed in each discharge space, and a discharge gas fills the discharge spaces.

In the PDP having the above structure, ultraviolet rays are emitted by plasma generated by discharges in the discharge spaces. The ultraviolet rays excite the phosphor layer, and the excited phosphor layer emits visible light to display images.

However, since the electrodes, the upper dielectric layer, and the protective layer are sequentially formed from the lower surface of the upper substrate, about 40% of the visible light emitted from the phosphor layer is absorbed by the above elements, and thus, there is a limit to improving the light emission efficiency. Moreover, since charged particles of the discharge gas are ion-sputtered onto the phosphor layer, a permanent residual image is generated and the life-span of the panel is reduced.

SUMMARY OF THE INVENTION

The present invention provides a PDP capable of operating at low voltage, and having high brightness and light emission efficiency.

The present invention also provides a PDP that can be fabricated in a large size, and can ensure a sufficient process margin and stability.

According to an aspect of the present invention, a Plasma Display Panel (PDP) is provided comprising: an upper substrate; a lower substrate facing the upper substrate; a plurality of blocks, each of which includes: a barrier rib of a dielectric material adapted to define discharge cells; upper discharge electrodes including upper discharge portions arranged in the barrier rib and upper connection portions connected to the upper discharge portions and protruding out of the barrier rib; and lower discharge electrodes including lower discharge portions arranged in the barrier rib and separated from the upper discharge portions and lower connection portions connected to the lower discharge portions and protruding out of the barrier rib; and phosphor layers arranged in the discharge cells; wherein the plurality of the blocks are connected to each other by connecting the upper connection portions and the lower connection portions thereof.

The upper and lower discharge portions preferably respectively surround the discharge cells.

A direction of extending the upper discharge electrodes and a direction of extending the lower discharge electrodes preferably cross each other.

One of the upper discharge electrodes and the lower discharge electrodes preferably performs as an address sustain electrode, and the other performs as a scan sustain electrode.

The plurality of blocks preferably further comprise address electrodes including address discharge portions arranged in the barrier rib and address connection portions connected to the address discharge portions and protruding out of the barrier rib; and wherein the address electrodes extend perpendicularly to the direction of extending the upper and lower discharge electrodes that are parallel to each other.

One of the upper discharge electrodes and the lower discharge electrodes preferably performs as a common electrode, and the other performs as a scan electrode.

The address discharge portion preferably surrounds a discharge cell.

The address electrode is preferably arranged either above the upper discharge electrode, or under the lower discharge electrode.

The address electrode is preferably alternatively arranged between the upper discharge electrode and lower discharge electrode.

The upper discharge electrode, the lower discharge electrode, and the address electrode preferably comprise a conductive metal.

The PDP preferably further comprises a conductive layer adapted to cover connected portions between the upper connection portions, connected portions between the lower connection portions, and the connected portions between the address connection portions.

The discharge cells defined by the barrier rib preferably comprise closed discharge cells.

The PDP preferably further comprises recesses corresponding to the discharge cells being arranged on a surface of the upper substrate facing the barrier rib; wherein the phosphor layers are respectively arranged in the recesses.

The phosphor layers arranged in the recesses of the upper substrate preferably comprise a transmissive phosphor material upon the visible light being transmitted through the upper substrate to display images.

The PDP preferably further comprises recesses corresponding to the discharge cells being arranged on a surface of the lower substrate facing the barrier rib; wherein the phosphor layers are respectively arranged in the recesses.

The phosphor layers preferably arranged in the recesses of the lower substrate comprise a reflective phosphor material upon the visible light being transmitted through the upper substrate to display images.

The discharge cells are preferably arranged on the plurality of blocks; wherein each block is adapted to form a unit pixel.

The PDP preferably further comprises an MgO layer adapted to cover the side surfaces of the barrier rib.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
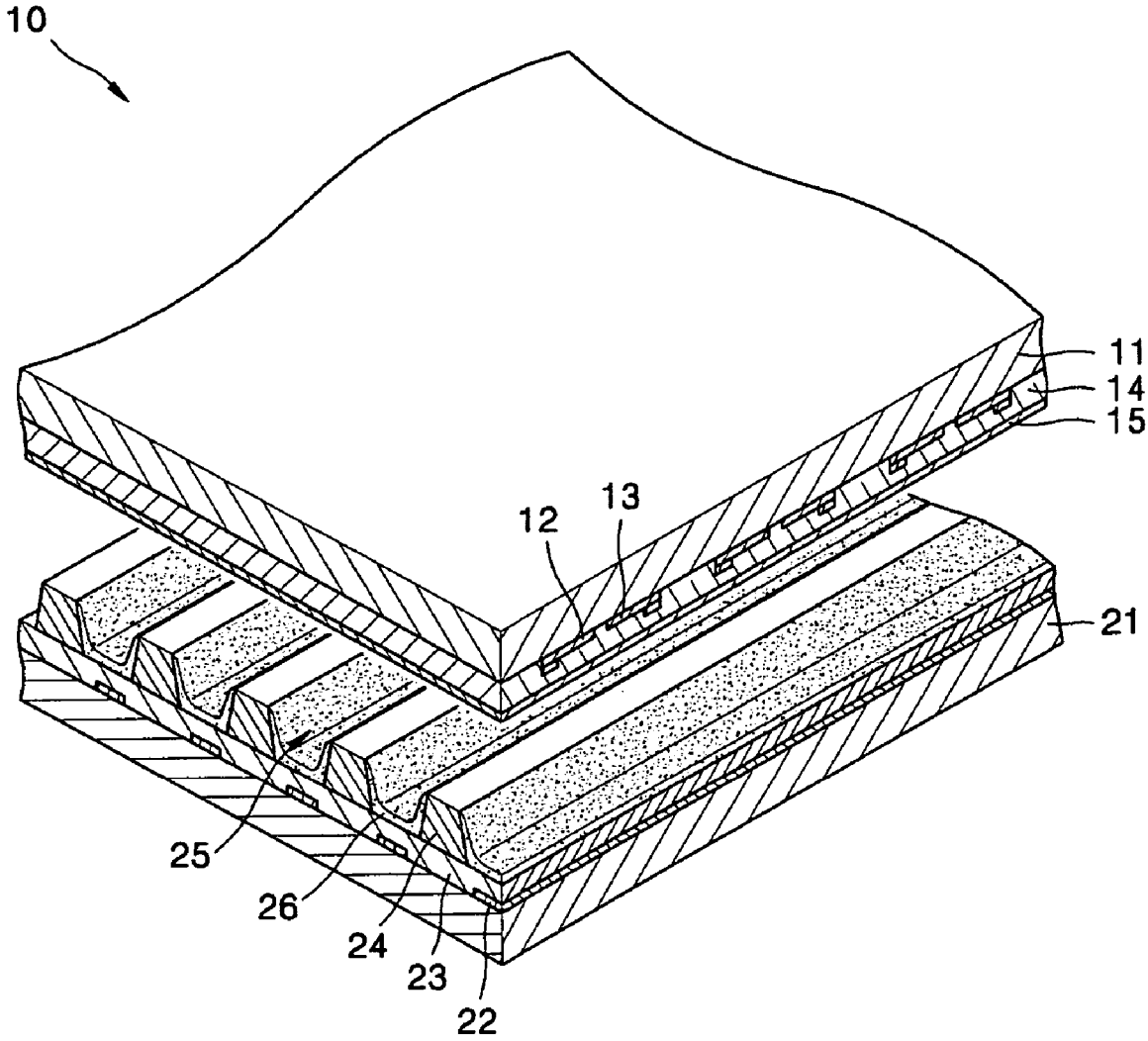
FIG. 1 is an exploded perspective view of a part of a Plasma Display Panel (PDP)

FIG. 1 is a perspective view of an AC PDP 10 having a three-electrode surface discharge structure.

The PDP 10 includes an upper substrate 11 and a lower substrate 21. Common electrodes 12 and scan electrodes 13 forming discharge gaps with the common electrodes 12 are formed on a lower surface of the upper substrate 11, and the common and scan electrodes 12 and 13 are embedded in an upper dielectric layer 14. A protective layer 15 is formed on a lower surface of the upper dielectric layer 14.

In addition, address electrodes 22 are formed on an upper surface of the lower substrate 21 to cross the common and scan electrodes 12 and 13, and the address electrodes 22 are embedded in a lower dielectric layer 23. Barrier ribs 24 are formed on an upper surface of the lower dielectric layer 23 and are separated from each other to define discharge spaces 25. A phosphor layer 26 is formed in each discharge space 25, and a discharge gas fills the discharge spaces 25.

In the PDP 10 having the above structure, ultraviolet rays are emitted by plasma generated by discharges in the discharge spaces 25. The ultraviolet rays excite the phosphor layer 26, and the excited phosphor layer 26 emits visible light to display images.

However, since the electrodes 12 and 13, the upper dielectric layer 14, and the protective layer 15 are sequentially formed from the lower surface of the upper substrate 11, about 40% of the visible light emitted from the phosphor layer 26 is absorbed by the above elements, and thus, there is a limit to improving the light emission efficiency. Moreover, since charged particles of the discharge gas are ion-sputtered onto the phosphor layer 26, a permanent residual image is generated and the life-span of the panel is reduced.

Figure 2:
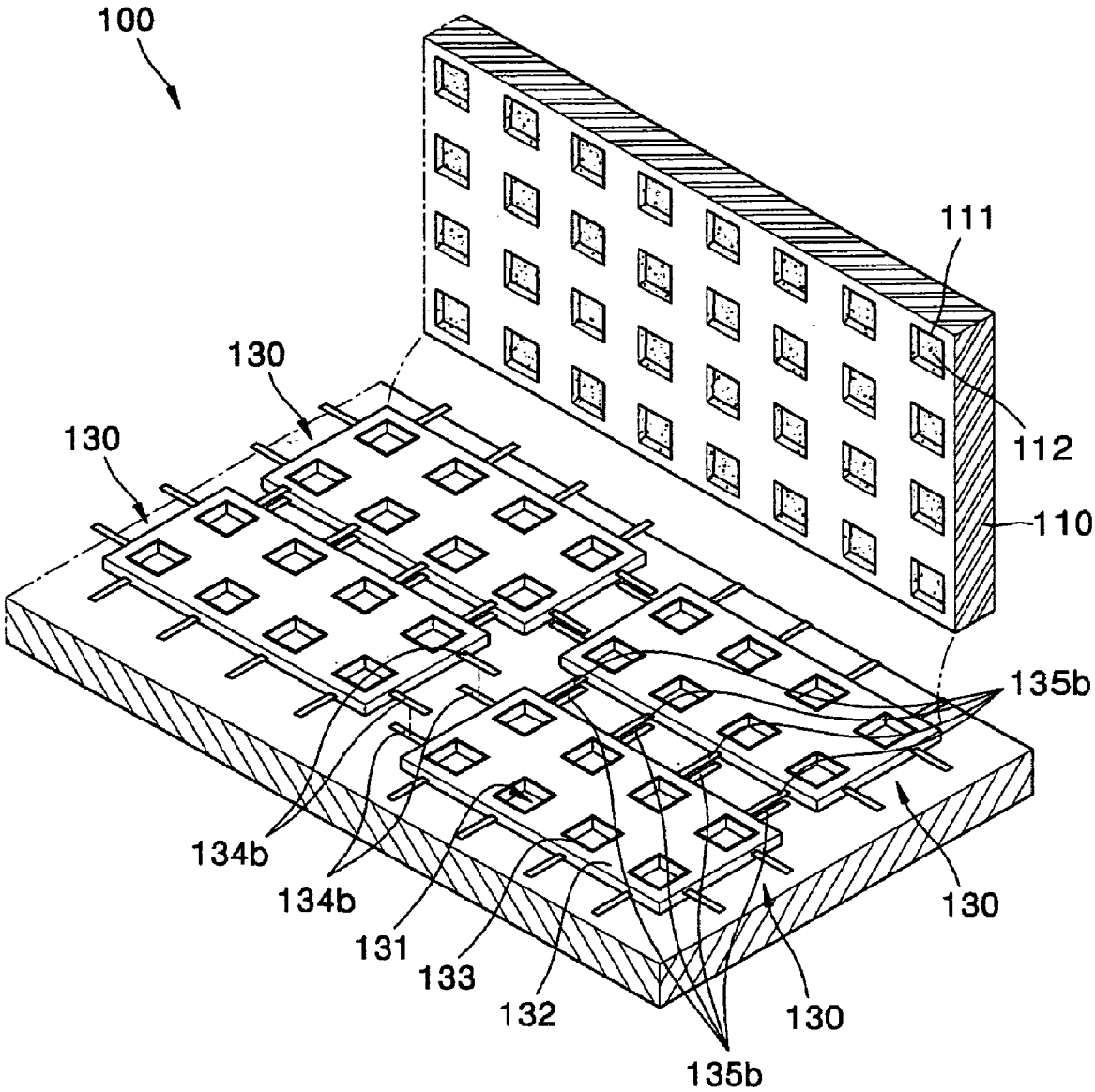
FIG. 2 is an exploded perspective view of a part of a PDP according to an embodiment of the present invention.

FIG. 2 is an exploded perspective view of a PDP 100 according to an embodiment of the present invention.

Referring to FIG. 2, the PDP 100 according to the present invention includes an upper substrate 110, and a lower substrate 120 facing the upper substrate 110. An image is displayed through at least one of the upper and lower substrates 110 and 120, and the substrate, through which the image is displayed, is formed of a light permeable material.

A plurality of blocks 130 are disposed between the upper and lower substrates 110 and 120. The blocks 130 are arranged parallel to the upper and lower substrates 110 and 120 and are connected to each other. That is, each of the blocks 130 includes upper connection portions **134*b* and lower connection portions 135*b*. The upper connection portions 134*b* respectively correspond to and are electrically connected to the upper connection portions 134*b* of an adjacent block 130, and the lower connection portions 135*b* respectively correspond to and are electrically connected to the lower connection portions 135*b* of the adjacent block 130, and thus, the blocks 130 are connected to each other. The blocks 130 can be fixedly attached to both sides of the upper and lower substrates 110 and 120**.

Discharge cells 131 are formed in the blocks 130 connected to each other, and phosphor layers 112 are disposed on the upper substrate 110 to correspond to the discharge cells 131 in a one-to-one arrangement. That is, the phosphor layers 112 are excited by ultraviolet rays generated during the discharge to emit visible light, and referring to FIG. 2, recesses 111 are formed on a lower surface of the upper substrate 110 facing the blocks 130, and the phosphor layers 112 are formed in the recesses 111. When visible light passes through the upper substrate 110, on which the phosphor layers 112 are disposed, to display images, it is preferable for the phosphor layers 112 to be formed of a transmissive phosphor material. Otherwise, the recesses 111 can be formed on the surface of the lower substrate 120 facing the blocks 130 and the phosphor layers 112 can be formed in the recesses 111. It is preferable for the phosphor layers 112 disposed on the lower substrate 120 to be formed of a reflective material when the image is displayed through the upper substrate 110.

Since the phosphor layers 112 are respectively disposed in the recesses 111 formed on the lower surface of the upper substrate 110, they can be separated far from the blocks 130 where the discharge occurs. Accordingly, the ion-sputtering of the phosphor layers 112 due to the charged particles can be prevented, and thus, the life-span of the panel can be improved. Also, the generation of a permanent residual image can be reduced noticeably even when the same image is displayed for a long time. Each of the phosphor layers 112 is formed of one of red, green, or blue phosphor materials respectively emitting red, green, or blue visible light, and accordingly, the phosphor layers 112 can be divided into red, green, and blue phosphor layers 112. In addition, the discharge cells can be divided into red, green, and blue sub-pixels according to the colors of the phosphor layers 112 disposed thereon. The red, green, and blue sub-pixels form a unit pixel to represent various colors by combining three primary colors.

Figure 3:
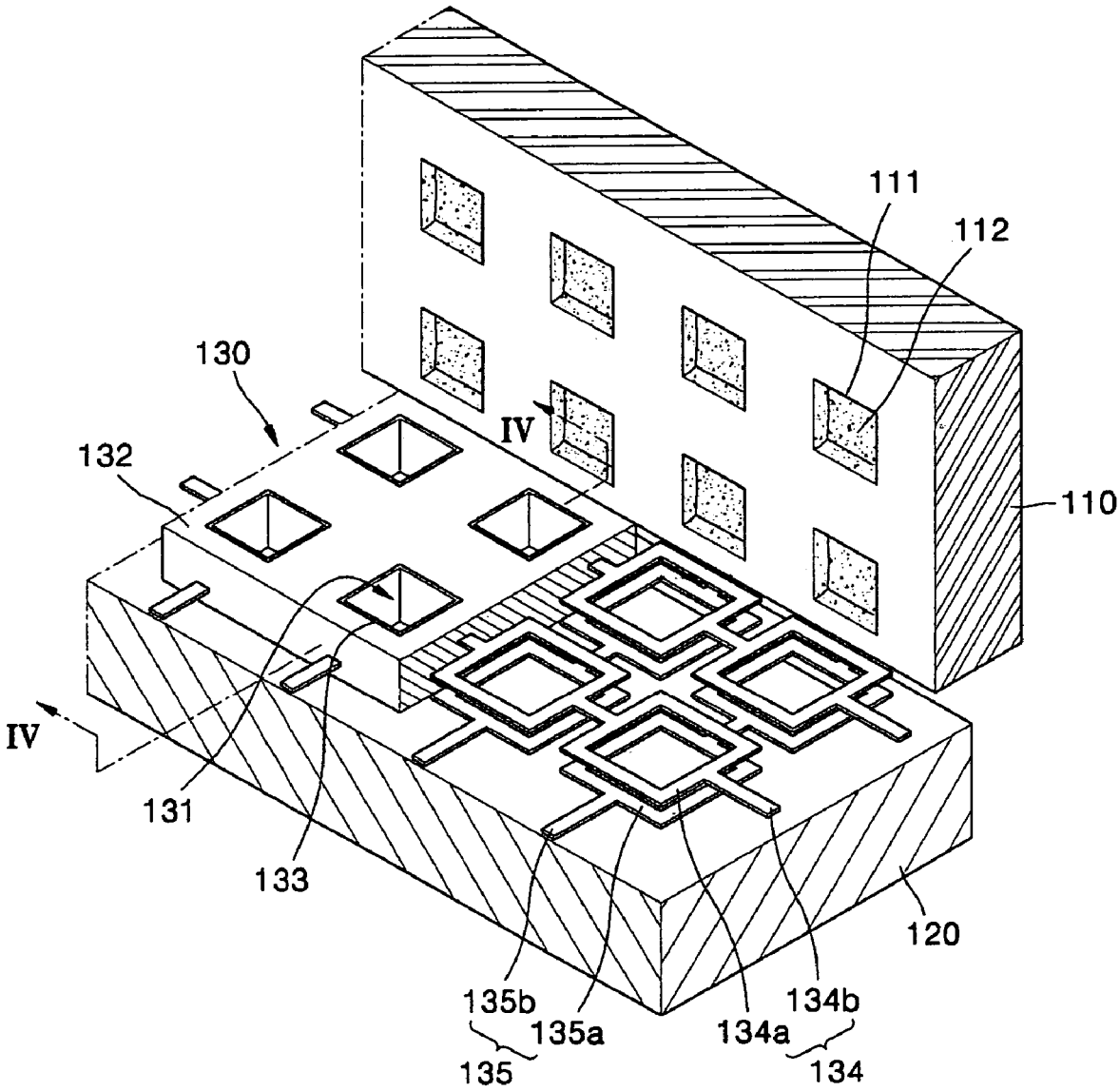
FIG. 3 is an exploded perspective view of a block of FIG. 2.
Figure 4:
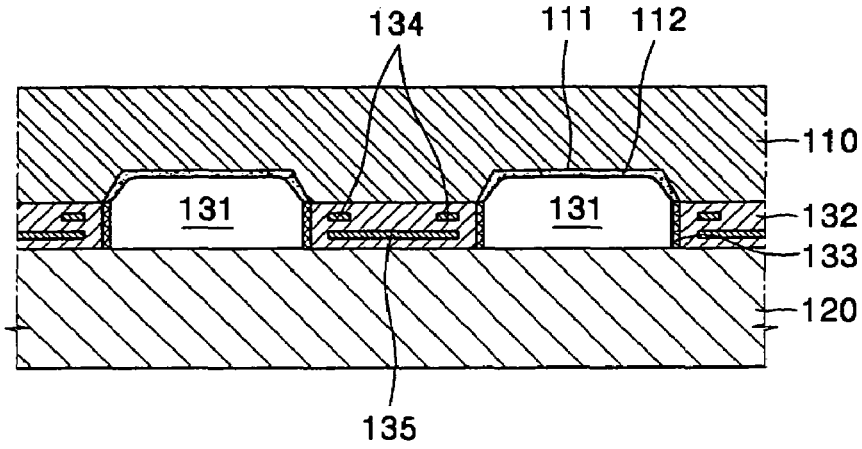
FIG. 4 is a cross-sectional view of the block of FIG. 2 taken along line IV-IV of FIG. 3.

FIG. 3 is an exploded perspective view of one of the blocks 130 of FIG. 2, and FIG. 4 is a cross-sectional view of the block 130 taken along line IV-IV of FIG. 3.

A barrier rib 132 is formed on the block 130. The barrier rib 132 defines the discharge cells 131 corresponding to the sub-pixels, and prevents a cross talk from occurring between the discharge cells 131. The barrier rib 132 is formed in a predetermined pattern, that is, a closed barrier rib in a matrix pattern. However, the shape of the barrier rib is not limited thereto, and can be formed as a closed rib in a waffle or delta pattern.

In addition, it is preferable for the discharge cells 131 defined by the barrier rib 132 to form the unit pixels. For example, if the unit pixel includes three discharge cells 131, the number of discharge cells 131 should be a multiple of 3 in every block 130, and if the unit pixel includes four discharge cells 131, the number of discharge cells 131 should be a multiple of 4 in every block 130. It is advantageous from a fabrication standpoint for the discharge cells 131 formed in every block 130 to respectively form unit pixels. In addition, the number of discharge cells formed in every block 130 is not limited to the above examples.

Upper discharge electrodes 134 and lower discharge electrodes 135 are disposed at upper and lower portions inside the barrier rib 132 so as to commonly surround the discharge cells 131. The upper discharge electrode 134 is disposed on the upper portion adjacent to the upper substrate 110, and the lower discharge electrode 135 is disposed on a portion under the upper discharge electrode 134. The upper and lower discharge electrodes 134 and 135 extend to cross each other, so that the discharge cell 131 can be selected. One of the upper and lower electrodes 134 and 135 performs as an address sustain electrode, and the other performs as a scan sustain electrode. The upper and lower discharge electrodes 134 and 135 can be formed of a conductive metal such as aluminum, copper, or silver. The electrode 134 or 135 formed of the conductive metal has a lower resistance than that of the electrode 135 or 134 formed of Indium Tin Oxide (ITO), and thus, a discharge response speed of the panel according to the present invention is faster than that of a panel using electrodes formed of ITO. The structures of the upper and lower discharge electrodes 134 and 135 are described in more detail later.

The barrier ribs 132, in which the upper and lower discharge electrodes 134 and 135 are disposed, is formed of a dielectric material, and accordingly, direct electrical conduction between the upper and lower discharge electrodes 134 and 135 can be prevented. In addition, the barrier rib 132 can prevent charged particles from directly colliding with the upper and lower discharge electrodes 134 and 135 during the discharge and thereby prevent the upper and lower discharge electrodes 134 and 135 from being damaged. Furthermore, the barrier rib 132 induces the charged particles to accumulate wall charges easily. The barrier rib 132 can be formed a dielectric material such as PbO, B2O3, or SiO2.

An MgO layer 133 can also be formed on side surfaces of the barrier rib 132. When the MgO layer 133 is formed, the direct collision of the charged particles onto the barrier rib 132 can be prevented by the MgO layer 133 during the discharge, and thus, damage to the barrier rib 132 caused by ion-sputtering of the charged particles can be prevented. Moreover, since the charged particles directly collide with the MgO layer 133, the MgO layer 133 can emit secondary electrons contributing to the discharge operation. Therefore, the panel can operate with a low voltage, and the light emission efficiency of the panel can be improved.

In addition, a discharge gas is contained within the discharge cells 131 defined by the barrier rib 132. The discharge gas can be a mixed gas including Xe generating ultraviolet rays and Ne functioning as a buffer.

The structures of the upper and lower discharge electrodes 134 and 135 disposed in the barrier rib 132 are described in more detail as follows.

The upper discharge electrodes 134 are separated from each other, and extend along a predetermined direction. According to the drawings, one upper discharge electrode 134 can surround four sides of the discharge cell 131, and the discharge cells 131 are arranged along the extending direction of the upper discharge cells 134.

That is, each of the upper discharge electrodes 134 includes an upper discharge portion 134*a* formed as a loop surrounding the discharge cell 131 and connected to other upper discharge portions 134*a* and arranged in a row, and an upper connection portion 134*b* formed on one side of the upper discharge portion 134*a*. The loop of the upper discharge portion 134*a* is formed as a square loop, and is disposed in the barrier rib 132. Accordingly, the upper discharge portion 134*a* can surround the four side portions of the discharge cell 131. In addition, the upper connection portion 134*b* protrudes from the barrier rib 132. The rows of the upper discharge electrodes 134 are separated from each other, and are disposed along a direction crossing the extending direction of the upper discharge electrodes 134. The separated portions between the upper discharge electrodes 134, that is, the separated portions between the loops of the upper discharge portions 134*a* in different rows form a set and are commonly disposed in the barrier rib 132 along the extending direction of the upper discharge electrodes 134.

The lower discharge electrodes 135 disposed under the upper discharge electrodes 134 are separated from each other, and extend along a direction perpendicular to the extending direction of the upper discharge electrodes 134. According to the drawings, one lower discharge electrode 135 can surround four sides of the discharge cell 131, and the discharge cells 131 are arranged along the extending direction of the lower discharge cells 135.

Each of the lower discharge electrodes 135 includes a lower discharge portion 135*a* formed as a loop surrounding the discharge cell 131 and connected to other lower discharge portions 134*a* and arranged in a row, and a lower connection portion 135*b* formed on one side of the lower discharge portion 135*a*. The loop of the lower discharge portion 135*a* is formed as a square loop, and is disposed in the barrier rib 132. Accordingly, the lower discharge portion 135*a* can surround the four side portions of the discharge cell 131. In addition, the lower connection portion 135*b* protrudes from the barrier rib 132. The rows of the lower discharge electrodes 135 are separated from each other, and are disposed along a direction crossing the extending direction of the lower discharge electrodes 135. The separated portions between the lower discharge electrodes 135, that is, the separated portions between the loops of the lower discharge portions 135*a* in different rows form a set and are commonly disposed in the barrier rib 132 along the extending direction of the lower discharge electrodes 135. The structures of the upper and lower discharge portions are not limited to the above examples, and can be formed in various structures such as a ladder structure.

Figure 5:
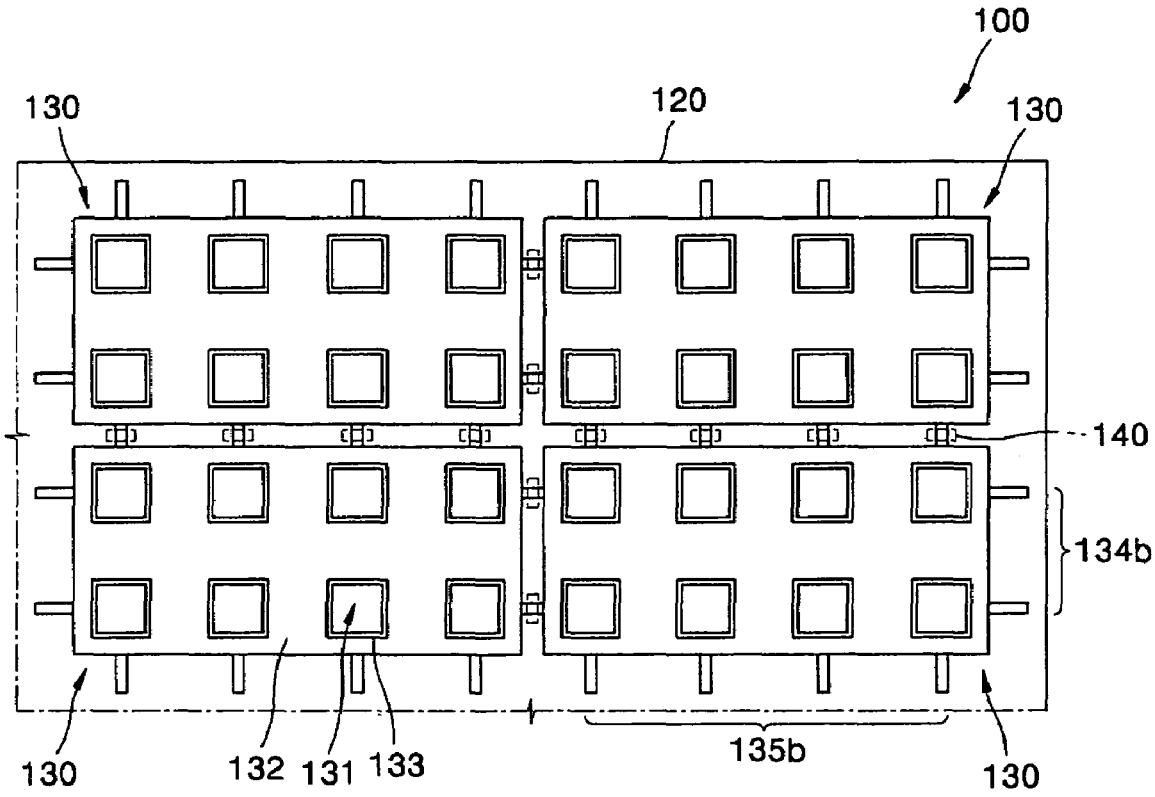
FIG. 5 is a plane view of the blocks of FIG. 2.
Figure 6:
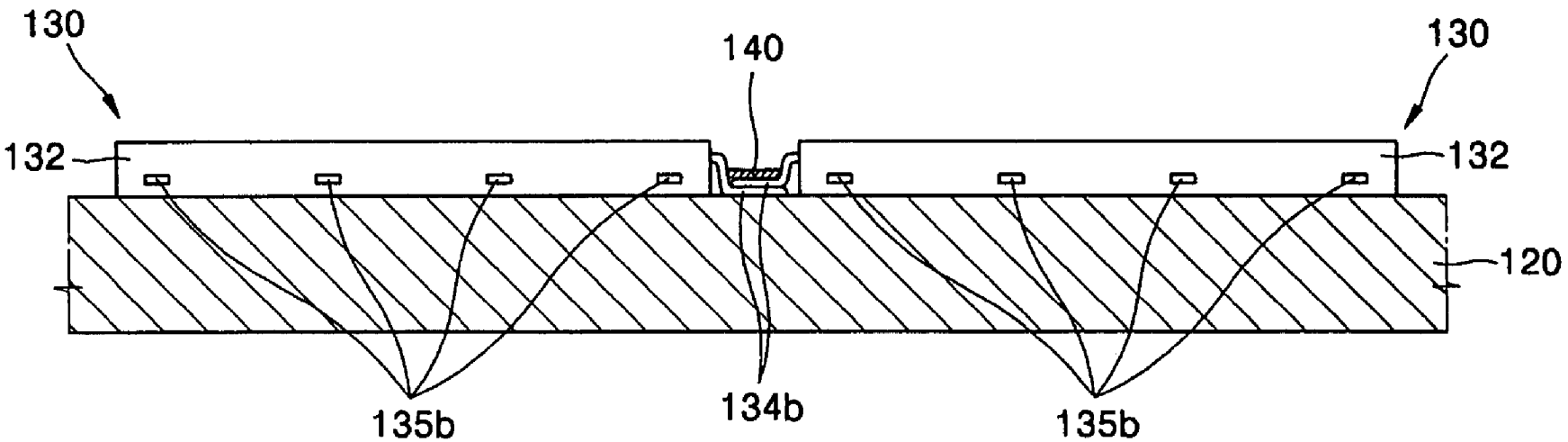
FIG. 6 is a side view of the connections between the blocks of FIG. 5.

FIG. 5 is a view of the blocks 130, respectively including the above structure, arranged and connected to each other on the lower substrate 120.

Referring to FIG. 5, the upper connection portions 134*b* drawn from the barrier rib 132 of the block 130 are connected to the upper connection portions 134*b* drawn from the barrier rib 132 of the adjacent block 130 in a one-to-one correspondence. The upper connection portions 134*b* are extended from the upper discharge portions 134*a* disposed in the barrier rib 132 as described above. The upper connection portions 134*b* can be connected to each other in various forms, for example, the upper connection portions 134*b* overlap with each other and are compressed by a heating and pressing device, for example, from the upper portion of the lower substrate 120 to be connected to each other as shown in FIG.

6. The connected portions between the upper connection portions 134*b* can be covered by a conductive layer 140, and accordingly, the connection between the upper connection portions 134*b* can be made stably and firmly.

In addition, like the upper connection portions 134*b*, the lower connection portions 135*b* drawn from the barrier rib 132 of the block 130 are connected to the lower connection portions 135*b* drawn from the barrier rib 132 of the adjacent block 130 in a one-to-one correspondence. The connecting structure between the lower connection portions 135*b* can be the same as that between the upper connection portions 134*b*.

The blocks 130 electrically connected to each other by the connecting of the upper connection portions 134*b* and the lower connection portions 135*b* are arranged so that the distances between the discharge cells 131 arranged in the transverse direction and the distances between the discharge cells 131 arranged in the longitudinal direction are constant.

In addition, in some blocks 130 arranged along edges of the lower substrate 120, the upper connection portions 134*b* extending out of the lower substrate 120 are electrically connected to a driving unit for the upper discharge electrodes 134, so that voltages can be supplied to the upper discharge electrodes 134 formed in the blocks 130. The lower connection portion 135*b* are electrically connected to a driving unit for the lower discharge electrodes 135, so that the voltages are supplied to the lower discharge electrodes 135 formed in the blocks 130.

As described above, in the PDP 100, the blocks 130 are separately fabricated, and then, the blocks 130 are attached between the upper and lower substrates 110 and 120. Therefore, it is easy to fabricate the panel having a large area, and a sufficient process margin and processing stability can be ensured.

The operations of the PDP 100 according to the present invention are described below as follows.

It is assumed that the upper discharge electrode 134 performs as the address sustain electrode and the lower discharge electrode 135 performs as the scan sustain electrode. When the address voltage is supplied to the upper discharge electrode 134 and the scan voltage is supplied to the lower discharge electrode 135, an address discharge occurs in a discharge cell 131 where the upper and lower discharge electrodes 134 and 135, to which the voltages are supplied, are commonly disposed. After the address discharge, a sustain voltage is alternately supplied between the upper and lower discharge electrodes 134 and 135, and then, the charged particles move in vertical direction to cause a sustain discharge. The sustain discharge concentrates at the upper portion in the discharge cell 131, and occurs in a direction perpendicular to all side surfaces defining the discharge cell 131. In addition, the sustain discharge occurring at all sides of the discharge cell 131 is diffusing to the center portion of the discharge cell 131. Therefore, the discharge area is larger than that of a usual panel, and a volume of the region where the sustain discharge occurs increases. Thus, a space charge that is not used in the usual panel can contribute to the light emission. Accordingly, the amount of plasma generated during the discharge can increase, and the panel can operate with a low voltage. The discharge gas generates ultraviolet rays due to the sustain discharge occurring in above mechanism. The phosphor layer 112 disposed in the discharge cell 131 is excited by the ultraviolet rays, and the excited phosphor layer 112 emits visible light.

Figure 7:
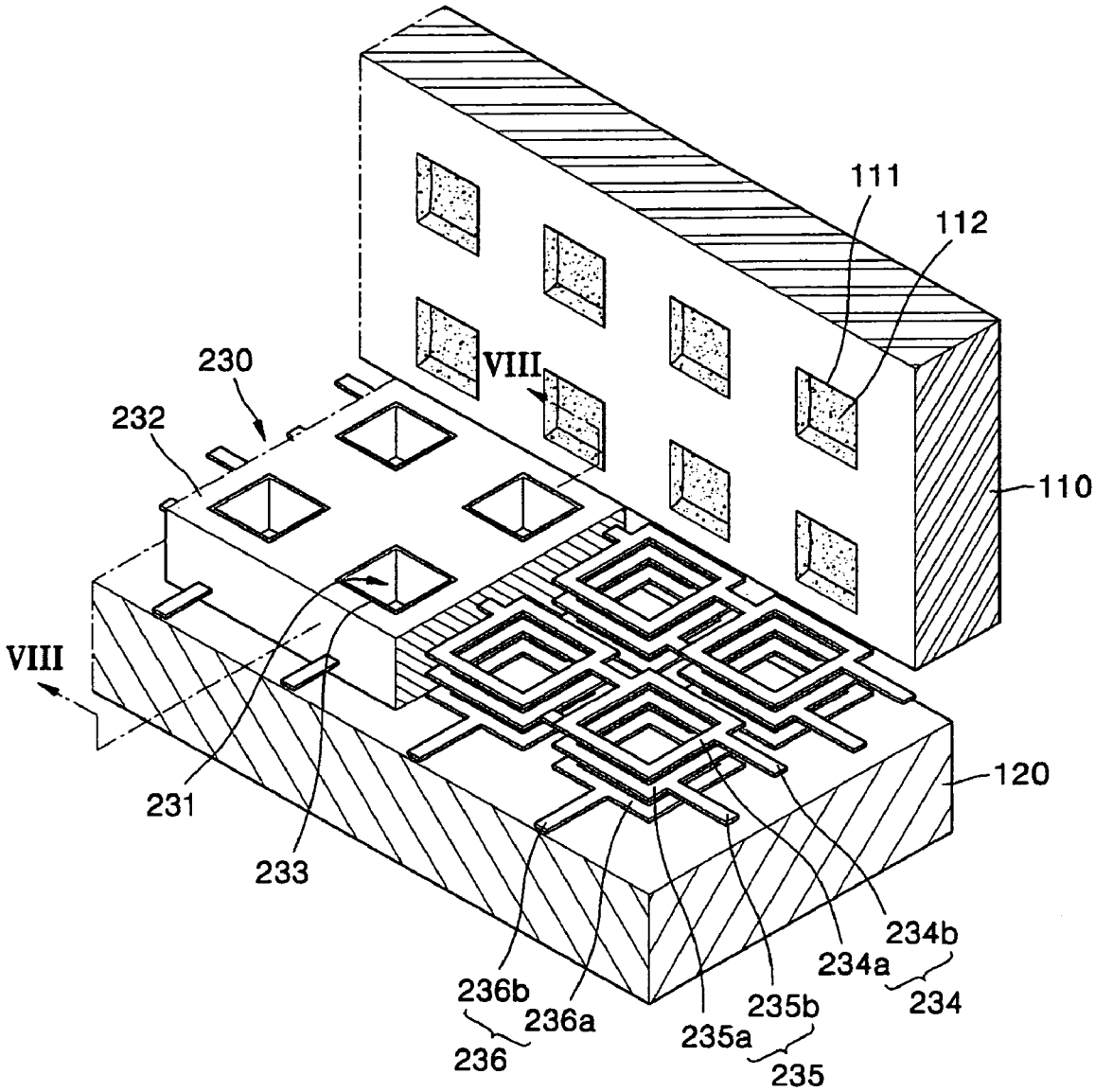
FIG. 7 is an exploded perspective view of another example of the block of FIG. 2.
Figure 8:
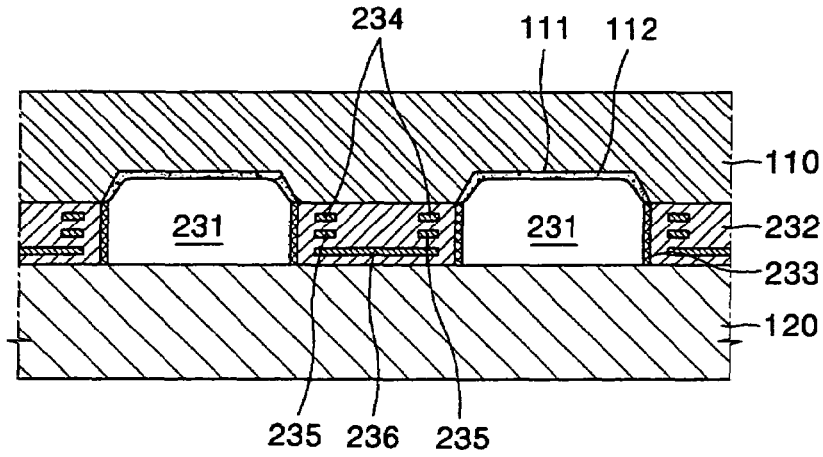
FIG. 8 is a cross-sectional view of the block of FIG. 2 taken along line VIII-VIII of FIG. 7.

FIGS. 7 and 8 are views of blocks according to another embodiment of the present invention. The same reference numerals as those of the previous drawings denote the same elements performing the same functions, and detailed descriptions thereof have been omitted.

Referring to FIGS. 7 and 8, the block 230 in the discharge cells 231 are defined by a barrier rib 232 having a closed structure of a matrix form as described in the above embodiment. The barrier rib 232 is formed of a dielectric material, and an MgO layer 233 is formed on side surfaces of the barrier rib 232. Upper discharge electrodes 234 and lower discharge electrodes 235 are disposed at upper and lower portions in the barrier rib 232 to surround the discharge cells 231, and address electrodes 236 are disposed under the lower discharge electrodes 235.

A discharge gas fills the discharge cells 231 defined by the barrier rib 232, and phosphor layers 112 are formed on the upper substrate 110 to correspond to the discharge cells 131 in a one-to-one correspondence. The phosphor layers 112 can be disposed in the recesses 111 that are formed on the lower surface of the upper substrate 110 in a predetermined pattern.

The upper and lower discharge electrodes 234 and 235 disposed in the barrier rib 232 extend parallel to each other, and the address electrodes 236 extend to cross the upper and lower discharge electrodes 234 and 235. One of the upper and lower discharge electrodes 234 and 235 performs as a common electrode, and the other performs as a scan electrode. It is preferable for the lower discharge electrode 235 that is adjacent to the address electrode 236 to perform as the scan electrode since the address voltage supplied between the lower discharge electrode 235 and the address electrode 236 can be lowered, and thus, an address discharge can sufficiently occur between the lower discharge electrode 235 and the address electrode 236. In addition, although the address electrode 236 is disposed under the lower discharge electrode 235 in the drawings, the address can be disposed above the upper discharge electrode 234 or can be disposed between the upper and lower discharge electrodes. When the address electrode is disposed above the upper discharge electrode 234, it is preferable for the upper discharge electrode 234 to perform as the scan electrode. The upper discharge electrodes 234, the lower discharge electrodes 235, and the address electrodes 236 can be formed of a conductive metal such as aluminum, copper, or silver.

The upper discharge electrodes 234 are separated from each other, and extend along a predetermined direction. According to the drawings, each of the upper discharge electrodes 234 includes an upper discharge portion 234*a* formed as a loop surrounding the discharge cell 231 and connected to other upper discharge portions 234*a* and arranged in a row, and an upper connection portion 234*b* formed on one side of the upper discharge portion 234*a*. The loop of the upper discharge portion 234*a* is formed as a square loop, and is disposed in the barrier rib 232. Accordingly, the upper discharge portion 234*a* can surround the four side portions of the discharge cell 231. In addition, the upper connection portion 234*b* protrudes from the barrier rib 232.

The lower discharge electrodes 235 disposed in parallel to the upper discharge electrodes 234 having the above structure have the same structures as those of the upper discharge electrodes 234. That is, one lower discharge electrode 135 can surround four side surfaces of the discharge cell 231, and the discharge cells 231 are arranged along the extending direction of the lower discharge electrodes 235. That is, the lower discharge electrodes 235 respectively include lower discharge portions 235*a* formed as loops surrounding the discharge cell 231 and connected to other lower discharge portions 234*a* and arranged in a row, and a lower connection portion 235*b* formed on one side of the lower discharge portion 235*a*. The loop of the lower discharge portion 235*a* is formed as a square loop, and is disposed in the barrier rib 232. Accordingly, the lower discharge portion 235*a* can surround the four side portions of the discharge cell 231. In addition, the lower connection portion 135*b* protrudes from the barrier rib 232. It is preferable for the upper connection portion 234*b* and the lower connection portion 235*b* to be disposed so as not to overlap each other in the up and down direction in order to be connected to the adjacent upper and lower connection portions 234*b* and 235*b*. In addition, the upper and lower discharge portions can be formed in various shapes such as a ladder shape.

In addition, the address electrodes 236 extending in the perpendicular direction to the upper and lower discharge electrodes 234 and 235 can have the same structures as those of the upper and lower discharge electrodes 234 and 235, that is, one address electrode 236 can surround the four side surfaces of each discharge cell 231. The address electrodes 236 respectively include address discharge portions 236*a* formed as loops surrounding the discharge cell 231 and connected to other address discharge portions 236*a* and arranged in a row to distribute the discharge, and an address connection portion 236*b* formed on one side of the address discharge portion 236*a* and protruding from the barrier rib 232. In addition, the address discharge portion is not limited to above example, and can be formed in a ladder structure or a stripe structure.

Figure 9:
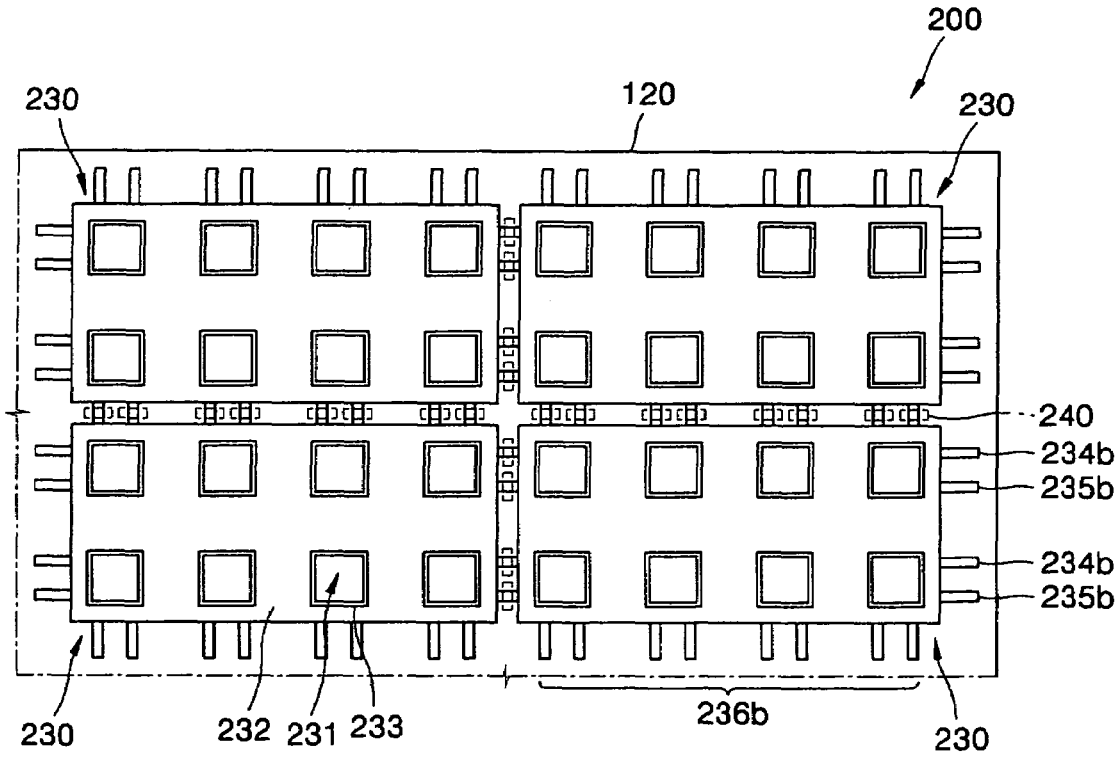
FIG. 9 is a plane view of the blocks of FIG. 7.

FIG. 9 is a view of the blocks 230 having the above structures and being arranged on the lower substrate 120 and connected to each other. Referring to FIG. 9, the upper connection portions 234*b* protruding from the barrier rib 232 at the blocks 230 are connected to the upper connection portions 234*b* protruding from the barrier rib 232 of the adjacent blocks 230 in a one-to-one correspondence. Connected portions between the upper connection portions 234*b* can be respectively covered by conductive layers 240, and accordingly, the connection between the upper connection portions 234*b* can be made stable and firm.

In addition, the lower connection portions 235*b*, disposed not to overlap with the upper connection portions 234*b*, are connected to the lower connection portions 235*b* formed in the adjacent blocks 230 in a one-to-one correspondence, and the address connection portions 236*b* are also connected to the address connection portions 236*b* of the adjacent blocks 230. The connected structure between the lower connections portions 235*b* can be formed to be the same as those between the upper connection portions 234*b*.

As described above, the blocks 230 electrically connected to each other by connecting the upper connection portions 234*b* to each other, the lower connection portions 235*b* to each other, and the address connection portions 236*b* to each other are disposed so that the distances between the discharge cells 231 arranged in the transverse direction on the entire lower substrate 120 and the distances between the discharge cells 231 arranged in the longitudinal direction are constant. In addition, in some blocks 230 arranged along edges of the lower substrate 120, the upper connection portions 234*b* extending out of the lower substrate 120 are electrically connected to a driving unit for the upper discharge electrodes 234, so that the voltages can be supplied to the upper discharge electrodes 234 formed in the blocks 230. The lower connection portion 235*b* are electrically connected to a driving unit for the lower discharge electrodes 235, so that the voltages are supplied to the lower discharge electrodes 235 formed in the blocks 230. In addition, the address connection portions 236*b* are electrically connected to a driving unit for the address electrodes 236, and thus, the voltages can be supplied to the address electrodes 236 formed on the blocks 230.

If the upper discharge electrode 234 performs as the common electrode and the lower discharge electrode 235 performs as the scan electrode, when the address voltages are supplied to the lower discharge electrode 235 and the address electrode 236, an address discharge occurs in the discharge cell 231 where the lower discharge electrode 235 and the address electrode 236, to which the address voltages are supplied, are commonly disposed. After the address discharge, when the sustain voltage is alternately supplied between the upper and lower discharge electrodes 234 and 235, the charged particles move in a vertical direction to cause the sustain discharge. Thus, the ultraviolet rays are generated by the discharge gas due to the sustain discharge, and excite the phosphor layer 112 disposed in the discharge cell 231. Thus, the excited phosphor layer 112 emits visible light.

As described above, according to the present invention, a plurality of blocks, each of which includes the barrier rib defining the discharge cells and the discharge electrodes surrounding the discharge cells in the barrier rib, are fabricated. Then, the blocks are disposed on the substrate and connected to each other. Therefore, it is easy to fabricate the PDP having a large area, and sufficient processing margin and processing stability can be ensured. In addition, since the discharge occurs at all side surfaces of the discharge cell, the discharge area can increase greatly. Therefore, the PDP can operate with a low voltage, and can have a high brightness and high light emission efficiency.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP), comprising:

an upper substrate;

a lower substrate facing the upper substrate;

a plurality of blocks, each of which includes:

a barrier rib of a dielectric material adapted to define discharge cells;

upper discharge electrodes including upper discharge portions arranged in the barrier rib and upper connection portions connected to the upper discharge portions and protruding out of the barrier rib; and lower discharge electrodes including lower discharge portions arranged in the barrier rib and separated from the upper discharge portions and lower connection portions connected to the lower discharge portions and protruding out of the barrier rib; and phosphor layers arranged in the discharge cells;

wherein the plurality of the blocks are connected to each other by connecting the upper connection portions and the lower connection portions thereof.

2. The PDP of claim 1, wherein the upper and lower discharge portions respectively surround the discharge cells.

3. The PDP of claim 1, wherein a direction of extending the upper discharge electrodes and a direction of extending the lower discharge electrodes cross each other.

4. The PDP of claim 3, wherein one of the upper discharge electrodes and the lower discharge electrodes performs as an address sustain electrode, and the other performs as a scan sustain electrode.

5. The PDP of claim 1, wherein the plurality of blocks further comprise address electrodes including address discharge portions arranged in the barrier rib and address connection portions connected to the address discharge portions and protruding out of the barrier rib; and wherein the address electrodes extend perpendicularly to the direction of extending the upper and lower discharge electrodes that are parallel to each other.

6. The PDP of claim 5, wherein one of the upper discharge electrodes and the lower discharge electrodes performs as a common electrode, and the other performs as a scan electrode.

7. The PDP of claim 5, wherein the address discharge portion surrounds a discharge cell.

8. The PDP of claim 5, wherein the address electrode is arranged either above the upper discharge electrode, or under the lower discharge electrode.

9. The PDP of claim 5, wherein the address electrode is arranged between the upper discharge electrode and lower discharge electrode.

10. The PDP of claim 5, wherein the upper discharge electrode, the lower discharge electrode, and the address electrode comprise a conductive metal.

11. The PDP of claim 5, further comprising a conductive layer adapted to cover connected portions between the upper connection portions, connected portions between the lower connection portions, and the connected portions between the address connection portions.

12. The PDP of claim 1, wherein the discharge cells defined by the barrier rib comprise closed discharge cells.

13. The PDP of claim 12, further comprising recesses corresponding to the discharge cells being arranged on a surface of the upper substrate facing the barrier rib; wherein the phosphor layers are respectively arranged in the recesses.

14. The PDP of claim 13, wherein the phosphor layers arranged in the recesses of the upper substrate comprise a transmissive phosphor material upon the visible light being transmitted through the upper substrate to display images.

15. The PDP of claim 12, further comprising recesses corresponding to the discharge cells being arranged on a surface of the lower substrate facing the barrier rib; wherein the phosphor layers are respectively arranged in the recesses.

16. The PDP of claim 15, wherein the phosphor layers arranged in the recesses of the lower substrate comprise a reflective phosphor material upon the visible light bwing transmitted through the upper substrate to display images.

17. The PDP of claim 1, wherein the discharge cells are arranged on the plurality of blocks; wherein each block is adapted to form a unit pixel.

18. The PDP of claim 1, further comprising an MgO layer adapted to cover the side surfaces of the barrier rib.

* * * * *